United States Patent [19]

Bishop

[11] 3,999,471

[45] Dec. 28, 1976

[54] FILTER HOOD DEVICE

[75] Inventor: Donald E. Bishop, Louisville, Ky.

[73] Assignee: American Air Filter Company, Inc., Louisville, Ky.

[22] Filed: Feb. 24, 1975

[21] Appl. No.: 552,255

[52] U.S. Cl. ..... 98/40 D; 98/114; 98/115 R; 29/190

[51] Int. Cl.[2] ..... F24F 7/00; F24F 13/06

[58] Field of Search ..... 98/40 D, 115 R, 42, 98/43, 114, 37; 29/190; 126/299 B; 285/3, 4

[56] References Cited

UNITED STATES PATENTS

| | | | |
|---|---|---|---|
| 2,229,388 | 1/1941 | Postewait | 98/114 |
| 3,082,680 | 3/1963 | Nevin et al. | 98/115 K |
| 3,232,205 | 2/1966 | Bumstead | 98/114 |
| 3,350,862 | 11/1967 | Nutting | 98/40 D |

*Primary Examiner*—William F. O'Dea
*Assistant Examiner*—Ronald C. Capossela
*Attorney, Agent, or Firm*—Jon C. Winger

[57] ABSTRACT

A filter hood device containing a gas treating filter and having a clean gas outlet aperture which is closed by a blank diffuser mounting panel. The blank diffuser mounting panel is adapted to be modified at a jobsite to receive a diffuser which is suitable for the requirements of that jobsite.

3 Claims, 7 Drawing Figures

FILTER HOOD DEVICE

BACKGROUND OF THE INVENTION

The present invention relates to ventilation devices and more particularly to hoods having air distribution means.

Filter hood units having a filter disposed therein and a filtered gas outlet are known. In addition, hoods having a gas flow diffuser element over the outlet for distributing the gas as it flows from the hood are also known. However, a drawback of the heretofore known hoods is that the diffuser element must be installed in the hood during the manufacturing operations. This, of course, requires that the parameters of the jobsite be known in advance of the manufacture of the hood or that a hood of approximately the right size and diffuser of approximately the right configuration, size and location in the hood be chosen from an assortment of premanufactured "in stock" hood and diffuser devices.

The first above-mentioned alternative is undesirable for the reason that very seldom is it possible to know all the gas flow parameters of a jobsite even with detailed plans to study. More times than not, on-the-job changes must be made to compensate for factors unknown at the planning stage of the jobsite.

The second above-mentioned alternative is also undesirable for the reasons mentioned in regard to the first alternative, and for the additional reason that an air distribution only approximating the desired distribution may be obtainable from "in stock" hood and diffuser devices.

SUMMARY OF THE INVENTION

The present invention recognizes these drawbacks of the prior art and provides a filter hood device which can be easily, quickly and inexpensively custom fitted at a jobsite with the exact gas flow diffuser in exactly the proper location in the filter hood device to satisfy the gas flow requirements of the jobsite.

More particularly, the present invention provides a filter hood device for filtering and distributing a gas, the hood device comprising an enclosure having an inlet aperture and an outlet aperture; a filter disposed within the enclosure to separate the inlet aperture from the outlet aperture; and a blank diffuser mounting panel attached to said enclosure closing the outlet separator.

DESCRIPTION OF THE DRAWINGS

A better understanding of the present invention can be had upon reference to the accompanying drawings in which like numerals refer to like parts throughout the several views and in which.

DESCRIPTION OF THE PREFERRED EMBODIMENT

Figure 1:
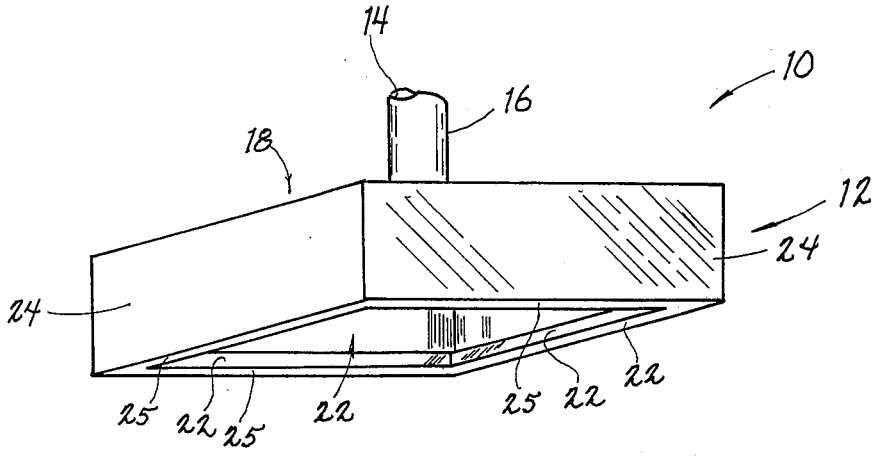
FIG. 1 is an isometric view of a filter hood device of the present invention.

With reference to FIG. 1, there is illustrated a filter hood device, generally denoted as the numeral 10, for filtering and distributing a gas.

The filter hood device 10 comprises an enclosure, such as a hood 12 having an inlet aperture 14 formed by a stack 16 attached to a top surface 18 of the hood 12 and an outlet aperture 20 at the bottom of the hood 12 generally opposite the inlet aperture 14. The outlet aperture 20 is defined by a peripheral upwardly projecting flange 22 which is spaced inwardly from and connected to the walls 24 of the hood 12 by a horizontally disposed web 25. The flange 22, wall 24 and horizontal web 25 cooperate to define an upward opening U-shaped trough (see FIGS. 3, 4 and 6). While the walls 24 of the hood 12 are illustrated as being vertical, it is to be understood that the walls 24 could just as readily be sloped.

Figure 2:
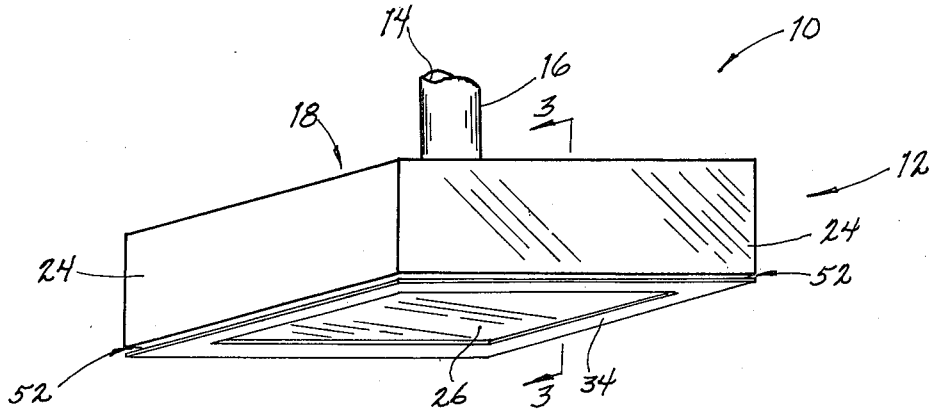
FIG. 2 is another isometric view of the filter hood device of the present invention showing a diffuser mounting panel installed therein.
Figure 3:
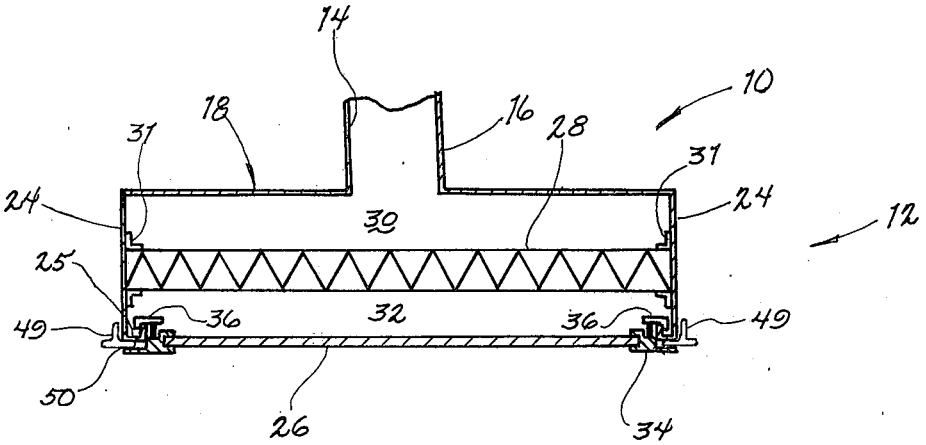
FIG. 3 is a cross-sectional view of the filter hood device of the present invention as viewed in the direction of arrows 3—3 in FIG. 2.

FIGS. 2 and 3 illustrate the filter hood device 10 further having a blank diffuser mounting panel 26 removably attached to the hood 12 completely closing the outlet aperture 20.

Figure 6:
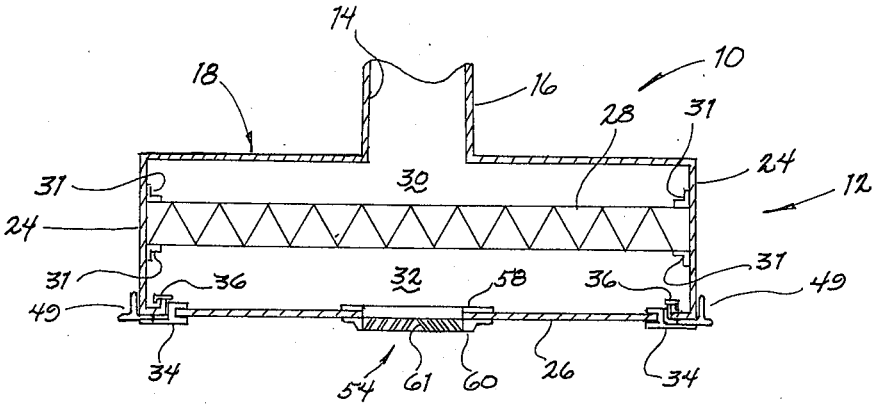
FIG. 6 is a cross-sectional view of the filter hood device similar to FIG. 3, but illustrating a conventional diffuser mounted therein.

With reference to FIGS. 3 and 6, a flow-through filter 28 is disposed within and across the hood 12 to completely separate the inlet aperture 14 from the outlet aperture 20. The filter 28, and hood 12 cooperate to define a dirty gas plenum 30 between the inlet aperture 14 and filter 28 and a clean gas plenum 32 between the filter 28 and outlet aperture 20. The periphery of the filter 28 sealingly abuts interior surface of the walls 24 to prevent dirty gas from leaking from the dirty gas plenum 30 into the clean gas plenum 32. The filter 28 can be held in place in the hood by any number of conventional means, and is, for the sake of illustration, shown to be held in place by means of segments of angle-iron 31.

Figure 4:
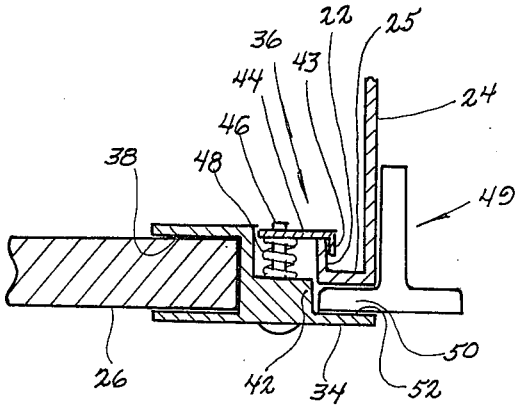
FIG. 4 is an enlarged sectional view of a segment of the filter device of FIG. 3 illustrating a clamping means of the present invention.

FIG. 4 best illustrates one clamping means by which the diffuser mounting panel 26 is removably attached to the hood 12. The clamping means comprises a peripheral frame member 34 which peripherally engages the diffuser mounting panel 26 and a plurality of brackets 36 which attach the peripheral frame 34 to the hood 12.

With particular reference to FIG. 4, the peripheral frame member 34 comprises a peripheral generally U-shaped channel 38 which opens inwardly of the outlet aperture 20 and a horizontally extending leg 40 which extends in an opposite direction, or outwardly of the aperture 20. A shoulder 42 is formed between the channel 38 and leg 40. The diffuser mounting panel 26 fits into the U-shaped channel and is, thus, captively thereby retained. In order to facilitate the insertion of the mounting panel 26 into the channel 38, one side of the peripheral frame 34 may be removable from the adjacent sides thereof in virtually any conventional manner such as be screws.

Each bracket 36 is generally L-shaped, one leg 43 being a downwardly projecting lip and the other leg 44 being generally horizontally disposed. Each bracket 36 is adjustably connected to the frame 34 by, for example, a screw 46 disposed through an appropriate smooth walled hole through the shoulder 42 between the U-shaped channel 38 and horizontal leg 40 and threaded into an appropriated threaded hole in the bracket 36. A compression coil spring 48 is disposed generally coaxially over the shank of the screw 46 between the bracket 36 and frame 34 in order to exert a biasing force therebetween.

To attach the diffuser mounting panel 26 over the outlet aperture 20, it is, as mentioned above, inserted into the U-shaped channel 38 of the frame 34. The assembled mounting panel 26 and frame 34 are then positioned such that the diffuser panel lies across the outlet aperture 20 and the peripheral frame 34 nestingly fits through the outlet aperture 20 with the shoulder 42 in juxtaposition to the upwardly projecting flange 22. Each L-shaped bracket 36 is positioned such that the leg 44 lies over the free end of the flange 22 and the lip 43 extends downwardly into the U-shaped trough formed by flange 22, web 25 and wall 24 with the adjustment screw located on the opposite side of the flange 22. Each adjustment screw 46 may then be threaded into or out of the threaded hole in its associated bracket 36 from the bottom side of the housing 12 to obtain the appropriate clamping force. When the screw 46 is tightened into the threaded hole in the bracket 36, the bracket 36 and frame 34 are caused to move toward each other, thus, exerting a vice-like grip on the upwardly extending flange 22 of the hood 12.

The filter hood device 10 of the present invention is particularly well suited for installation in a ceiling formed of a plurality of horizontally disposed intersecting beams. Such a ceiling construction is illustrated in FIGS. 3, 4 and 6 by T-beams 49. One horizontal arm 50 of a T-beam 49 is inserted in the gap 52 between the horizontal web 25 of the hood 12 and the horizontal leg 40. As the screw 46 is threaded into the hole in the bracket 36, the leg 40 of the frame 34 moves toward the web 25 of the hood 12 and the arm 50 of the T-beam 49 is captively held therebetween in a vice-like grip, thus, holding the filter hood device 10 in place in the beamed ceiling construction.

Figure 5:
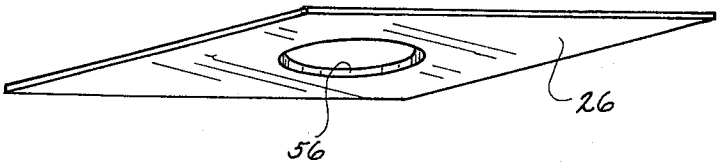
FIG. 5 is an isometric view of a diffuser mounting panel of the present invention.

Turning now to FIGS. 5 and 6, there is shown the diffuser mounting panel 26 having at least one gas flow diffuser 54 mounted in and attached to the heretofore blank diffuser mounting panel 26. In order to mount the diffuser 54, the panel 26 must be adapted to receive it such as by having a diffuser mounting aperture 56 in the panel (see FIG. 5) with, for example, a saw or metal snips.

Figure 7:
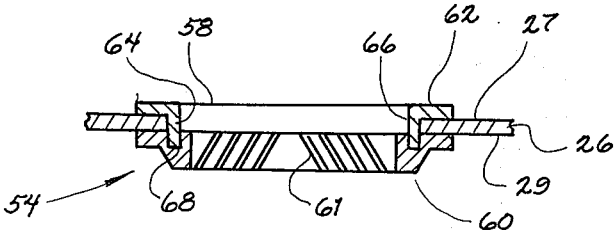
FIG. 7 is an enlarged sectional view of a segment of FIG. 6 more clearly illustrating the conventional diffuser mounted to the diffuser mounting panel.

Virtually any conventional diffuser may be mounted in the panel 26 because a mounting aperture of any shape may be cut in the panel 26 at a jobsite using conventional hand tools. For exemplary purposes, the diffuser 54 is illustrated in FIGS. 6 and 7 as comprising an inner shell 58 and an outer shell 60 having a series of gas directing vanes 61 to direct the flow of clean gas exiting from the clean gas plenum 32 through the diffuser. The inner shell 58 includes a ledge 62, adapted to abut the top surface 27 of the panel 26, and an annular lip 64 extending therefrom and defining a flow-through aperture 66. The lip 64 is adapted to be received through the diffuser mounting aperture 56 formed in the panel 26. The outer shell 58 includes an annular notch 68 which receives the portion of the lip 64 projecting from the bottom surface 29 of the panel 26. The inner and outer shells 58 and 60 may be secured to the panel 26 by appropriate fastening means such as conventional screws (not shown) which force the shells 58 and 60 together with a vice-like grip against both surfaces 27 and 29 of the panel 26.

The hood 12 and blank diffuser mounting panel 26 can be made of virtually any material, the only criteria for the material of the blank diffuser mounting panel 26 being that it is capable of being cut by conventional cutting tools such as a saw or snips. In practice, aluminum has been found to be a satisfactory material from which to fabricate the blank diffuser mounting panel.

The filter hood device 10 of the present invention is well suited for custom tayloring the gas flow therefrom to exactly comply with the as-built parameters of a particular jobsite for the reasons that virtually any conventional diffuser can be mounted to it as the jobsite. The diffuser to be used does not have to be selected in advance of the time for installation of the hood device in ignorance of changes to the jobsite which have been made subsequent to the planning stage. The diffuser selection can wait until the jobsite has been completed with its as-built modifications from the plan and, therefore, with full knowledge of the actual gas flow parameters of the actual jobsite.

The foregoing detailed description is given primarily for clearness of understanding and no unnecessary limitations should be understood therefrom for modifications will be obvious to those skilled in the art upon reading this disclosure and may be made without departing from the spirit of the invention or scope of the appended claims.

What is claimed is:

1. A filter hood device adaptable for filtering and distributing a gas, comprising:

a hood having a gas inlet aperture and a gas outlet aperture;

a gas filter disposed within said hood separating said inlet aperture from said outlet aperture;

a removable blank diffuser mounting panel closing said outlet aperture;

diffuser mounting panel holding means comprising:

a. an upstanding projecting flange defining said outlet aperture, said upwardly projecting flange being spaced inwardly a predetermined distance from the walls of the hood and connected to the walls of said hood by a horizontal web;

b. a peripheral inwardly opening channel adapted to receive said diffuser panel; and, c. an oppositely extending horizontally disposed leg adapted to be disposed in spaced juxtaposition to said horizontal web of said hood; and, at least one bracket adapted to connect said frame to said hood.

2. The filter hood device defined in claim 1, wherein said bracket is generally L-shaped and comprises:

a downwardly extending lip;

a horizontally extending leg, the intersection of said lip and said leg being adapted to engage the free end of said upwardly extending peripheral flange of said hood;

a threaded aperture in said horizontal leg; and, a screw threadable receivable in said threaded aperture.

3. The filter device as defined in claim 1, further comprising at least one gas flow diffuser mounted in an appropriate aperture formed in said diffuser mounting panel.

* * * * *